US010604879B2

(12) United States Patent
Sang et al.

(10) Patent No.: US 10,604,879 B2
(45) Date of Patent: Mar. 31, 2020

(54) LAUNDRY TREATMENT APPARATUS

(71) Applicant: LG Electronics Inc., Seoul (KR)

(72) Inventors: Minkyu Sang, Seoul (KR); Kwangchul Heo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/252,240

(22) Filed: Jan. 18, 2019

(65) Prior Publication Data

US 2019/0153647 A1 May 23, 2019

Related U.S. Application Data

(63) Continuation of application No. 15/837,144, filed on Dec. 11, 2017, now Pat. No. 10,184,199, which is a (Continued)

(30) Foreign Application Priority Data

May 30, 2014 (KR) ..... 10-2014-0065884

(51) Int. Cl.
*D06F 29/00* (2006.01)
*D06F 39/00* (2020.01)
(Continued)

(52) U.S. Cl.
CPC ..... *D06F 29/005* (2013.01); *D06F 39/005* (2013.01); *D06F 39/125* (2013.01);
(Continued)

(58) Field of Classification Search
None
See application file for complete search history.

(56) References Cited

U.S. PATENT DOCUMENTS

2002/0056293 A1* 5/2002 Kin ..... D06F 39/125 68/12.26
2008/0271263 A1 11/2008 Bae
(Continued)

FOREIGN PATENT DOCUMENTS

CN 1352332 6/2002
CN 101529009 9/2009
(Continued)

OTHER PUBLICATIONS

Sato Maki, Switch Structure of Electronic Equipment, Espacenet Jan. 17, 2008 (Year: 2008).*
(Continued)

*Primary Examiner* — Cristi J Tate-Sims
(74) *Attorney, Agent, or Firm* — Fish & Richardson P.C.

(57) ABSTRACT

A laundry treatment apparatus includes a cabinet having an upper surface, the upper surface being configured to receive an object thereon, a drawer adapted to be drawn from the cabinet, a drum disposed in the drawer and defining a space for receiving laundry, a driving unit configured to rotate the drum, a control unit configured to control the driving unit, and a connector unit configured to impact an ability of the control unit to control operation of the driving unit based on whether or not the object is placed on the upper surface of the cabinet by preventing the control unit from controlling operation of the driving unit based on the object being absent from the upper surface of the cabinet and by allowing the control unit to control operation of the driving unit based on the object being placed on the upper surface of the cabinet.

16 Claims, 6 Drawing Sheets

Related U.S. Application Data continuation of application No. 14/725,718, filed on May 29, 2015, now Pat. No. 9,840,799.

(51) Int. Cl.

| | |
|---|---|
| ***D06F 58/28*** | (2006.01) |
| ***D06F 39/12*** | (2006.01) |
| *D06F 33/02* | (2006.01) |

(52) U.S. Cl.

CPC ..... *D06F 58/28* (2013.01); *D06F 29/00* (2013.01); *D06F 33/02* (2013.01); *D06F 2202/12* (2013.01)

(56) References Cited

U.S. PATENT DOCUMENTS

| | | | | |
|---|---|---|---|---|
| 2009/0139273 | A1 | 6/2009 | Kim et al. | |
| 2009/0145175 | A1* | 6/2009 | Kim | D06F 29/005 68/27 |
| 2010/0011609 | A1 | 1/2010 | Park et al. | |
| 2010/0083711 | A1 | 4/2010 | Han | |
| 2014/0238087 | A1* | 8/2014 | Bae | D06F 31/00 68/27 |

FOREIGN PATENT DOCUMENTS

| | | |
|---|---|---|
| EP | 0238115 | 9/1987 |
| EP | 2063014 | 9/2013 |
| EP | 1452636 | 10/2015 |
| JP | S52-053371 | 10/1977 |
| JP | S58-113228 | 8/1983 |
| JP | S59-085694 | 5/1984 |
| JP | S62-202717 | 12/1987 |
| JP | H03-076591 | 7/1991 |
| JP | H05-080492 | 11/1993 |
| JP | H10-069832 | 3/1998 |
| JP | H10-283871 | 10/1998 |
| JP | 2003-257277 | 9/2003 |
| JP | 2008-010162 | 1/2008 |

OTHER PUBLICATIONS

Maki, Switch Structure of Electronic Equipment, J P2008010162A, 2008 (Year: 2008).

Office Action issued in Canadian Application No. 2,893,188 dated Jun. 7, 2016, 3 pages.

Office Action issued in Chinese Application No. 201510292695.X dated Dec. 5, 2016, 17 pages (with English translation).

Notice of Allowance issued in Russian Application No. 2015118975 dated Nov. 14, 2016, 13 pages (with English translation).

Chinese Notice of Allowance in Chinese Application No. 201510292695X, dated May 19, 2017, 7 pages (with English translation).

European Search Report dated Aug. 26, 2015 from corresponding European Patent Application No. 15169817.2, 7 pages.

* cited by examiner

LAUNDRY TREATMENT APPARATUS

CROSS-REFERENCE TO RELATED APPLICATION

This application is a continuation of U.S. application Ser. No. 15/837,144, filed Dec. 11, 2017, which is a continuation of U.S. application Ser. No. 14/725,718 (now U.S. Pat. No. 9,840,799), filed on May 29, 2015, which claims the benefit of Korean Patent Application No. 10-2014-0065884, filed on May 30, 2014. The disclosures of the prior applications are incorporated by reference in their entirety.

TECHNICAL FIELD

The present disclosure relates to a laundry treatment apparatus.

BACKGROUND

Generally, a laundry treatment apparatus can include an apparatus adapted to wash laundry, an apparatus adapted to dry laundry, and an apparatus adapted to perform both washing and drying of laundry.

A front-loading laundry treatment apparatus (also called a drum washing machine) is designed to allow laundry to be put into the apparatus from the front of the apparatus and has an introduction port through which laundry can be put into the apparatus. Since the front-loading laundry treatment apparatus has an introduction port positioned at a level lower than a user's waist, use of the apparatus may be inconvenient in that a user has to stoop to put laundry into the apparatus or take laundry out of the apparatus.

In order to eliminate such inconvenience, among conventional laundry treatment apparatuses, a laundry treatment apparatus in which a support platform is additionally provided at a front-loading laundry treatment apparatus has been proposed.

Such a support platform provided is intended to raise the height of an introduction port and not for performing a function of laundry treatment such as washing or drying of laundry.

SUMMARY

According to one aspect, a laundry treatment apparatus includes a cabinet having an upper surface, the upper surface being configured to receive an object thereon, a drawer adapted to be drawn from the cabinet, a drum disposed in the drawer and defining a space for receiving laundry, a driving unit configured to rotate the drum, a control unit configured to control the driving unit, and a connector unit configured to impact an ability of the control unit to control operation of the driving unit based on whether or not the object is placed on the upper surface of the cabinet by preventing the control unit from controlling operation of the driving unit based on the object being absent from the upper surface of the cabinet and by allowing the control unit to control operation of the driving unit based on the object being placed on the upper surface of the cabinet.

Implementations according to this aspect may include one or more of the following features. For example, the object may be a second laundry treatment apparatus. The connector unit may be configured to open and close a circuit that connects the control unit to the driving unit, the connector unit being configured to prevent the control unit from controlling operation of the driving unit by opening the circuit based on the object being absent from the upper surface of the cabinet and being configured to allow the control unit to control operation of the driving unit by closing the circuit based on the object being placed on the upper surface of the cabinet. The laundry treatment apparatus may further include a display unit configured to display operation information of the laundry treatment apparatus, the display unit being configured to maintain operation regardless of whether the circuit is open or closed. The connector unit may be configured to open and close a circuit that supplies power to the control unit and the driving unit, the connector unit being configured to prevent the control unit from controlling operation of the driving unit by opening the circuit based on the object being absent from the upper surface of the cabinet and being configured to allow the control unit to control operation of the driving unit by closing the circuit based on the object being placed on the upper surface of the cabinet. The laundry treatment apparatus may further include comprising a display unit configured to display operation information of the laundry treatment apparatus, wherein the control unit and the display unit are configured to be maintained in a state of being connected to a circuit for supplying power to the control unit and the display unit, wherein the connector unit is configured to open and close the circuit for supplying power to the control unit and the display unit, and wherein the display unit is configured to maintain operation regardless of whether the circuit for supplying power to the control unit and the display unit is open or closed. The connector unit may include a switch body mounted within the cabinet, the switch body defining a body through hole, a slider disposed in the body through hole, a first end of the slider being exposed to an outside of the cabinet and a second end of the slider being configured to reciprocate within the switch body, and a contact disposed in the switch body and configured to open and close a circuit that connects the control unit to the driving unit by being manipulated by the slider. The laundry treatment apparatus may further include a sealing member configured to prevent foreign materials from being introduced into the switch body through the body through hole. The upper surface of the cabinet may define a cabinet through hole, and the laundry treatment apparatus may further include a support plate fixed to the slider and disposed in the cabinet through hole, the slider having a surface area larger than a cross-sectional area of the slider. The laundry treatment apparatus may further include a sealing member configured to prevent foreign materials from being introduced into the switch body through the body through hole.

Further according to this aspect, the upper surface of the cabinet may define a cabinet through hole, and the connector unit may include a housing mounted within the cabinet, the housing defining a through hole that is disposed vertically below the cabinet through hole, a switch fixed to the housing and configured to open and close a circuit that connects the control unit to the driving unit, and a press unit configured to reciprocate within the housing through hole to actuate the switch. The switch may include a switch body fixed to the housing and disposed outside the housing through hole, a slider having a first end disposed in the housing through hole and a second end configured to reciprocate within the switch body, and a contact disposed in the switch body and configured to open and close a circuit that connects the control unit to the driving unit by being manipulated by the slider. The laundry treatment apparatus may further include a press guider unit configured to guide the reciprocating movement of the press unit. The press unit may include a support plate disposed in the cabinet through hole and configured to contact the object based on the object being placed on the upper surface of the cabinet, and a press body configured to reciprocate within the housing through hole by movement of the support plate that presses the slider. The laundry treatment apparatus may further include an inclined surface provided at at least one of the press body and the first end of the slider exposed through the housing through hole. The laundry treatment apparatus may further include a second laundry treatment apparatus mounted on the upper surface of the cabinet, wherein the second laundry treatment apparatus may be the object and include a second cabinet mounted on the upper surface of the cabinet and configured to actuate the connector unit, a second drum disposed in the second cabinet and defining a space for receiving laundry, and a second driving unit configured to rotate the second drum.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated as part of this application, illustrate implementations of the disclosure and together with the description serve to explain the principle of the disclosure. In the drawings.

DETAILED DESCRIPTION

Reference will now be made in detail to the implementations of the present disclosure, examples of which are illustrated in the accompanying drawings. Wherever possible, the same reference numbers will be used throughout the drawings to refer to the same or like parts.

Figure 1A:
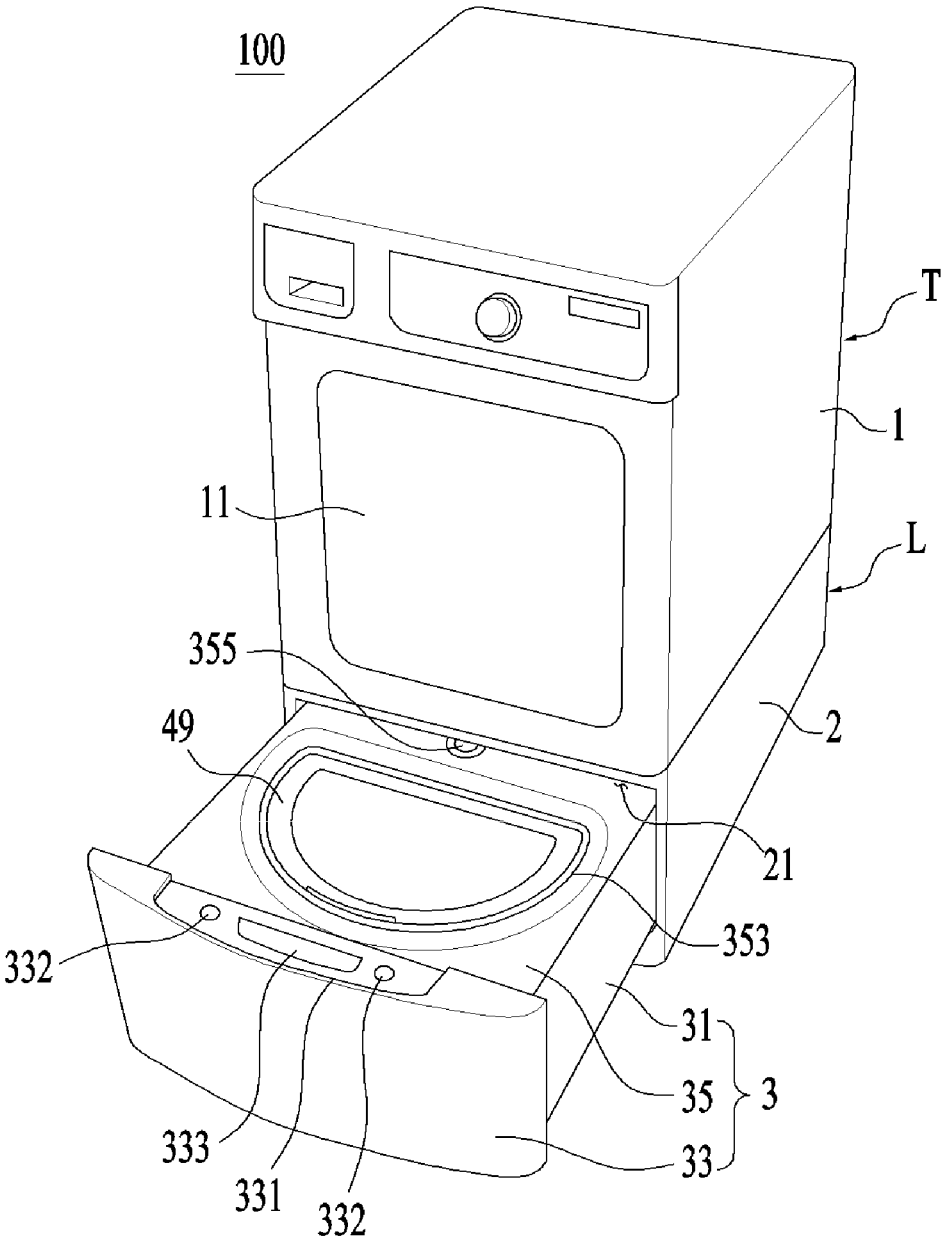
FIGS. 1A and 1B are views showing an example laundry treatment apparatus according to the present disclosure.
Figure 1B:
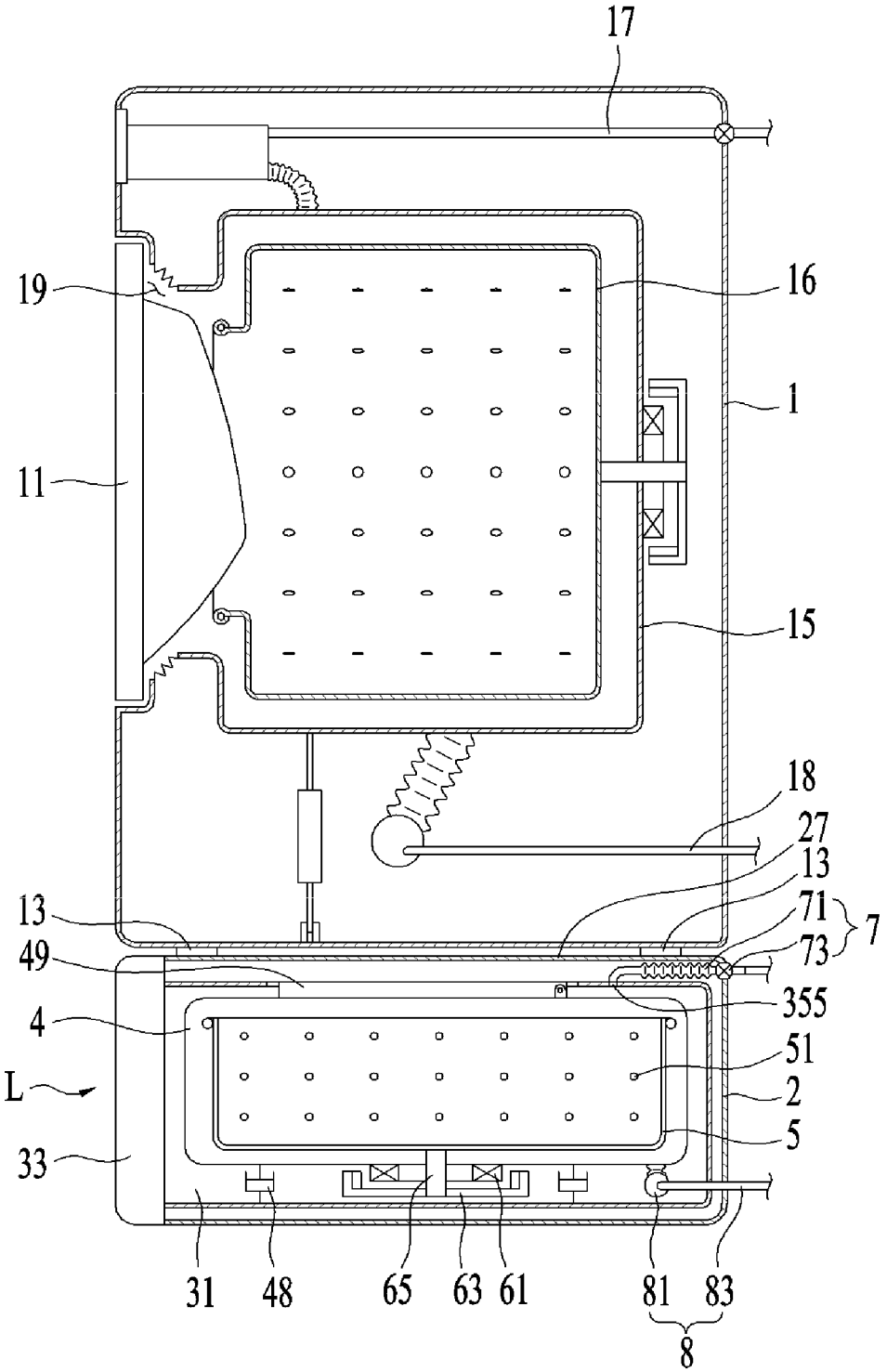

A laundry treatment apparatus according to the present disclosure may refer only to a first treatment apparatus L. As shown in FIGS. 1A and 1B, the laundry treatment apparatus according to the present disclosure may also refer collectively to the first treatment apparatus L and a second treatment apparatus T. For convenience of explanation, the present disclosure will now be described in connection with a laundry treatment apparatus 100 that includes both the first treatment apparatus L and the second treatment apparatus T.

The first treatment apparatus L is an apparatus for performing a function of laundry treatment such as washing or drying of laundry, and the second treatment apparatus T is an apparatus which is detachably mounted on the first treatment apparatus L and performs a function of laundry treatment.

The second treatment apparatus T may include a second cabinet 1 defining an exterior appearance thereof and mounted on an upper surface of the first treatment apparatus L, a second tub 15 disposed in the second cabinet 1 to contain washing water, a second drum 16 rotatably disposed in the second tub 15 and defining a space for containing laundry, a second water supply unit 17 for supplying washing water to the second tub 4, and a second water discharge unit 18 for discharging washing water contained the second tub 15 to the outside of the second cabinet 1.

The second cabinet 1 includes a second treatment apparatus introduction port 19 which allows laundry to be put in or taken out of the second drum 16. The second treatment apparatus introduction port 19 is opened and closed by a second treatment apparatus door 11 hinged to the second cabinet 1.

The second treatment apparatus introduction port 19 communicates with the inside of the second drum 16 through a second tub introduction port formed at the second tub 15 and a second drum introduction port formed at the second drum 16. Accordingly, a user may put laundry into the second drum 16 or may take the laundry contained in the second drum 16 out of the second cabinet 1 by opening the second treatment apparatus door 11.

When the second treatment apparatus T is designed to also perform a function of drying of laundry, the second cabinet 1 can be provided therein with a second hot air supply unit for supplying hot air to the second tub 15.

The second hot air supply unit may include a circulation duct for circulating air in the second tub 15, and a heat exchange unit disposed at the circulation duct to dehumidify and heat the air discharged from the second tub 15.

Alternatively, the second hot air supply unit may also include a discharge duct for discharging air in the second tub 15 to the outside of the second cabinet 1, a supply duct for supplying air outside the second cabinet 1 to the second tub 15, and a heat exchange unit disposed at the supply duct to heat air introduced into the supply duct.

Unlike the above construction, if the second treatment apparatus T is designed to perform a function of drying of laundry, the second treatment apparatus may not need the second tub 15. In this case, the second hot air supply unit has to supply hot air to the second drum 16 may be provided in the second cabinet 1.

The first treatment apparatus L incorporated in the laundry treatment apparatus according to the present disclosure includes a cabinet 2 supporting the second cabinet 1, a drawer 3 disposed in the cabinet 2 to be drawable therefrom, and an accommodation unit 4, 5 disposed in the drawer 3 and serving as a treatment space of laundry.

The cabinet 2 defines an exterior appearance of the first treatment apparatus L. The cabinet 2 may be configured to have any shape so long as the second treatment apparatus T is mountable on an upper surface 27 of the cabinet 2.

The cabinet 2 includes an open surface 21 such that the drawer 3 is drawn from the cabinet 2 through the open surface 21 or is accommodated in the cabinet 2. The open surface 21 may be disposed at a side (a front side of the second treatment apparatus T) at which the second treatment apparatus door 11 is positioned.

The drawer 3 includes a drawer body 31 having an open upper surface, and a drawer cover 35 disposed at the open upper surface of the drawer body 31.

The drawer body 31 may be configured to have a hexahedral shape having a hollow cavity defined therein. The drawer cover 35 is fixed to the drawer body 31 to define the upper surface of the drawer body 31.

The drawer body 31 includes a drawer panel 33 provided at a front surface thereof. The drawer panel 33 serves not only as means for opening and closing the open surface 21 of the cabinet 2 but also as means for drawing the drawer body 31 from the cabinet 2 and putting the drawer body 31 into the cabinet 2.

The drawer panel 33 may include a control panel 331 for controlling operation of the first treatment apparatus L. The control panel 331 serves to allow a user to input control commands for control of units (the water supply unit 17 and the water discharge unit 18) for supplying washing water to the accommodation unit 4, 5 and discharging the washing water from the accommodation unit 4, 5, a unit for rotation laundry (a driving unit), units for supplying steam or hot air to laundry (the hot air supply unit and a moisture supply unit) and the like.

Furthermore, the control panel 331 may be provided with an input unit 332 for allowing a user to input control commands into the first treatment apparatus L, and a display unit 333 (a unit for displaying operation information of the first treatment apparatus) for allowing a user to check control commands input through the input unit 332 or for showing execution state of the control commands input by a user.

The drawer cover 35 may be provided with an introduction opening 353 formed through the drawer cover 35 to communicate the inside of the drawer body 31 with the outside of the drawer body 31, and a water supply opening 355 formed through the drawer cover 35 to guide washing water to the accommodation unit 4, 5.

The accommodation unit 4, 5 provided in the drawer 3 may include a tub 4 provided in the drawer body 31 to provide a space for containing laundry, and a drum 5 rotatably provided in the tub 4 to contain laundry.

The tub 4 is supported in the drawer 3 by means of tub supports 48. The tub supports 48 may be embodied as a vibration damping device such as a spring or a damper.

The tub 4 is provided at an upper surface thereof with a door 49 for communicating the inside of the tub 4 with the outside of the tub 4. The door 49 is hinged to the upper surface of the tub 4. The door 49 may be taken out of the drawer 3 through the introduction opening 353 formed at the drawer cover 35. Accordingly, by drawing the drawer 3 from the cabinet 2 and then opening the door 49, a user may put laundry into the tub 4.

The tub 4 is provided at an upper surface thereof with an inflowing opening for allowing washing water supplied from the water supply opening 355 formed at the drawer 3 to be introduced into the tub 4. The inflowing opening may be formed to connect the water supply opening 355 to the upper surface of the tub 4, and may be embodied as a hole disposed below the water supply opening 355 and formed through the upper surface of the tub 4.

The drum 5 may be configured to have a cylindrical shape having an open upper surface. The drum 5 may be rotated in the tub 4 by the driving unit 6 provided outside the tub 4.

The driving unit 6 may include a stator 61 fixed to the tub 4 to generate rotating magnetic field, a rotor 63 rotated by the rotating magnetic field, and a driving shaft 65 extending through the tub 4 and connecting the drum 5 to the rotor 63.

The drum 5 is provided at an outer circumferential surface thereof with a drum through holes 51 to communicate the inside of the drum 5 with the inside of the tub 4.

The accommodation unit can include the tub 4 and the drum 5 so that the first treatment apparatus L can perform a function of washing. Therefore, in order for the first treatment apparatus L to also perform a function of drying laundry, the cabinet 2 has to be provided therein with a hot air supply unit for supplying hot air to the tub 4.

Since the hot air supply unit provided at the first treatment apparatus L may be configured in the same manner as the second hot air supply unit which has been previously described, detailed description thereof is omitted.

If the first treatment apparatus L is configured to perform only a function of drying laundry, the accommodation unit can include only the drum 5, and the hot air supply unit provided at the first treatment apparatus has to supply hot air to the drum 5.

The first treatment apparatus L according to the present disclosure is connected to a water supply source positioned outside the laundry treatment apparatus 100 through the water supply unit 7. The water supply unit 7 may include a water supply pipe 73 for connecting the water supply source to the water supply opening 355, and a valve 71 for opening and closing the water supply pipe 73 by a control unit C.

Washing water contained in the tub 4 is discharged to the outside of the cabinet 2 through a water discharge unit 8. The water discharge unit 8 may include a water discharge pipe 83 for guiding washing water contained in the tub 4 to the outside of the cabinet 2, and a pump 81 (controlled by the control unit) provided at the water discharge pipe 83 to discharge washing water contained in the tub 4.

In the first treatment apparatus L configured as described above, since laundry is contained in the drum 5, the center of mass is displaced forward when a user draws the drawer 3 from the cabinet 2.

When the center of mass of the first treatment apparatus L is displaced forward by drawing the drawer 3 from the cabinet 2, there is a probability that a rear portion of the first treatment apparatus L may be separated from the ground, that is, the first treatment apparatus L may be turned over in a forward direction.

When the second treatment apparatus T is mounted on the upper surface of the first treatment apparatus L, for example by being placed on top of the first treatment apparatus L, the above-mentioned problem may be addressed. Additionally, suppression of vibration of the first treatment apparatus L may be achieved.

Since an occasion that a user uses only the first treatment apparatus L in the state in which the second treatment apparatus T is not mounted on the first treatment apparatus L may occur, the first treatment apparatus L according to the present disclosure further includes connector unit that allows the first treatment apparatus L to be operated only when an object such as the second treatment apparatus T is mounted on the first treatment apparatus L. The object may have, for example, a shape and/or mass such that its placement on top of the first treatment apparatus L helps prevent the first treatment apparatus from tipping over to become separated from the ground.

Figure 2A:
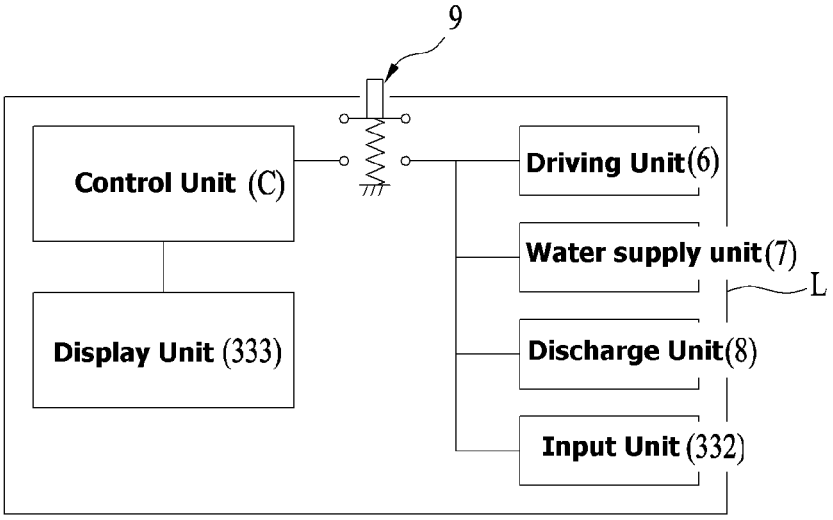
FIGS. 2A and 2B illustrate example schematic diagrams of the laundry treatment apparatus.
Figure 2B:
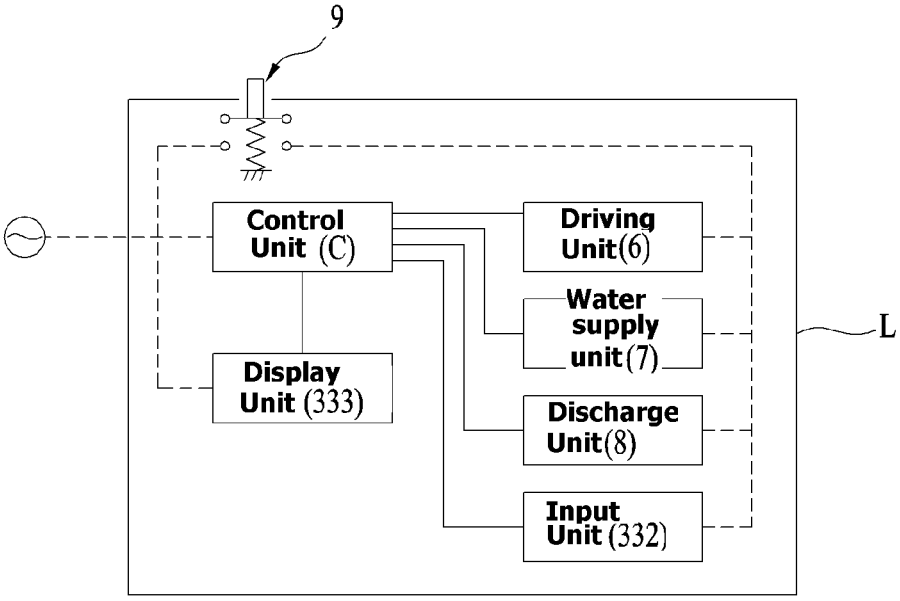

Referring to FIGS. 2A and 2B, the first treatment apparatus L can include a connector unit 9 that may be configured to open and close a communication circuit between the control unit C and components to be controlled (the driving unit 6, the water supply unit 7, the water discharge unit 8, the input unit 332 and the display unit 333), or to open and close a power circuit for supplying power to the control unit C and the components to be controlled. Furthermore, the connector unit 9 may be configured to open and close a power circuit for supplying power to the components to be controlled. In some cases, the connector unit 9 may physically open and close the circuit using a physical switch. Alternatively, or additionally, the connector unit 9 may open and close the circuit using other known circuit components for opening and closing the circuit.

FIG. 2A illustrates an implementation in which the first treatment apparatus L is operated by opening or closing the communication circuit between the control unit C and the components to be controlled only when the second treatment apparatus T is mounted on the upper surface of the first treatment apparatus L.

FIG. 2A illustrates an implementation in which the connector unit 9 opens and closes the circuit for connecting the control unit C to some of the components to be controlled. Specifically, FIG. 2A illustrates a construction in which the driving unit 6, the water supply unit 7, the water discharge unit 8 and the input unit 332 are connected to the control unit C through the connector unit 9 while the display unit 333 is maintained in the state of being connected (electrically connected) to the control unit C.

Unlike the construction shown in FIG. 2A, the circuit for connecting the display unit 333 to the control unit C may also be opened and closed by the connector unit 9. However, according to the present disclosure, only the circuit for connecting the display unit 333 to the control unit C is provided independently from the connector unit 9 in order to prepare for when a user intends to operate the first treatment apparatus L even when the second treatment apparatus T is not mounted on the upper surface of the first treatment apparatus L.

Specifically, if the state in which the circuit for connecting the display unit 333 to the control unit C is maintained in a state of being connected to the control unit C, it is possible to display on the display unit 333 a message indicating that the second treatment apparatus T has to be mounted on the upper surface of the first treatment apparatus L in order to activate the first treatment apparatus L, thus preventing a user from having a suspicion that the first treatment apparatus L malfunctions.

Furthermore, when the state in which the circuit for connecting the display unit 333 to the control unit C is maintained in a state of being connected to the control unit C, it may be possible to notify a user of a way of how to actuate the connector unit 9 (mounting an object capable of pressing the connector unit on the upper surface of the first treatment apparatus L) when a user intends to activate the first treatment apparatus L even though the second treatment apparatus T is not mounted on the upper surface of the first treatment apparatus L.

FIG. 2B illustrates an implementation in which the first treatment apparatus L can be operated by opening or closing the power circuit for supplying power to the components by the connector unit 9 only when the second treatment apparatus T is mounted on the upper surface of the first treatment apparatus L.

Specifically, FIG. 2B illustrates an implementation in which the control unit C and the display unit 333 are supplied with power from a power source regardless of operation of the connector unit 9 but the driving unit 6, the water supply unit 7, the water discharge unit and the input unit 332 are supplied with power only when the connector unit 9 is pressed by an external object such as the second treatment apparatus T.

Unlike the construction shown in FIG. 2B, the control unit C and the display unit 333 may also be supplied with power only when the connector unit 9 is pressed by an object mounted on the upper surface of the second treatment apparatus T. However, according to the present disclosure, only the control unit C and the display unit 333 are supplied with power regardless of whether the connector unit 9 is pressed in order to prepare for when a user intends to operate the first treatment apparatus L even when the second treatment apparatus T is not mounted on the upper surface of the first treatment apparatus L.

Considering the fact that the input unit 332 and the display unit 333 are provided at a single control panel 331, the input unit 332 may be independently supplied with power, together with the display unit 333, regardless of operation of the connector unit 9.

The connector unit 9, which performs the above-mentioned functions, may be disposed at any positions on the upper surface 27 of the cabinet 2 at which the connector unit can contact an external object mounted on the upper surface 27 of the first treatment apparatus L.

Figure 3:
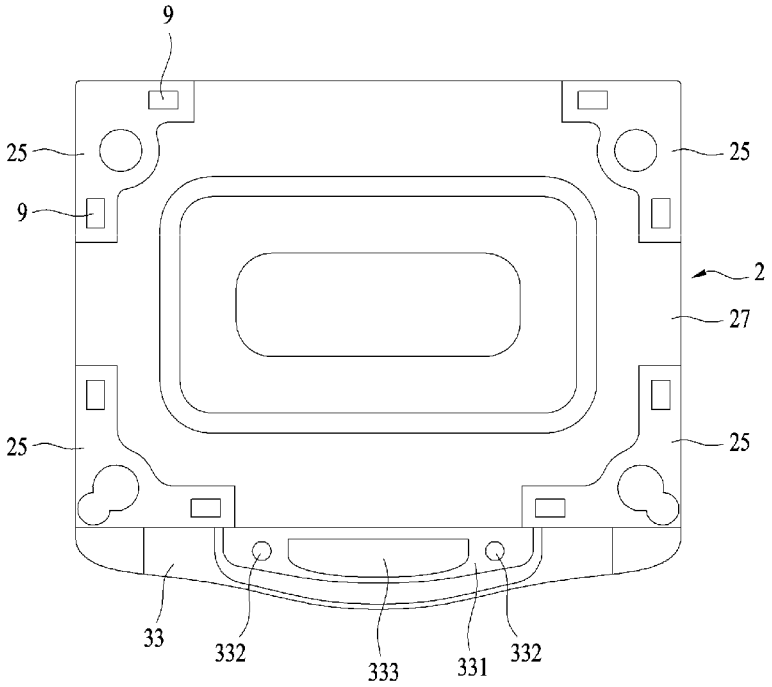
FIG. 3 is a plan view showing an upper surface of the laundry treatment apparatus.

FIG. 3 illustrates an implementation in which the connector unit 9 is positioned at a rear side of the upper surface 27 of the cabinet 2 (a side opposite the open surface 21). The connector unit 9 provided at the upper surface 27 may include only one connector unit, and may also include two or more connector units.

The connector unit 9 can be a critical component that determines operation of the first treatment apparatus L. Accordingly, having two or more connector units 9 ensures that, when one of the connector units 9 malfunctions, the first treatment apparatus L can be reliably operated through the other connector unit 9.

Figure 4A:
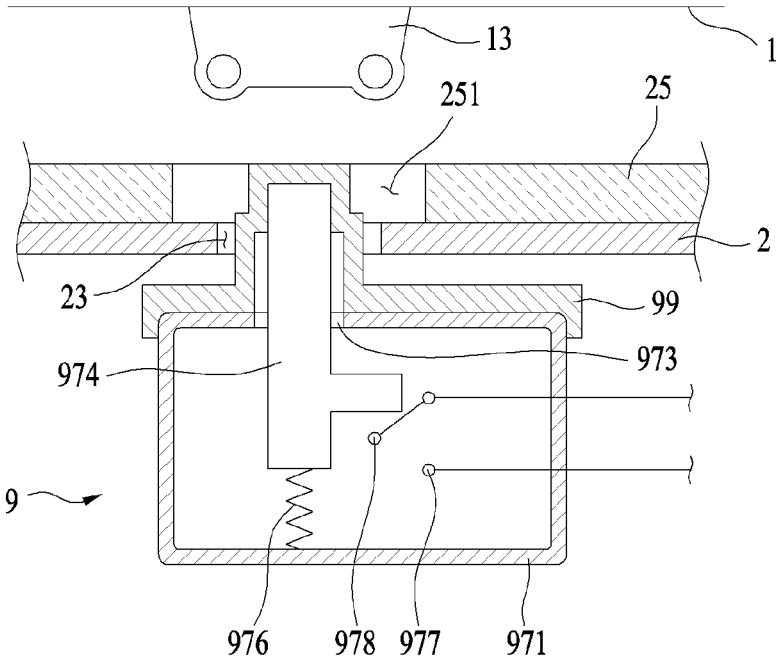
FIGS. 4A and 4B are views showing a connector unit provided in the laundry treatment apparatus according to one implementation.
Figure 4B:
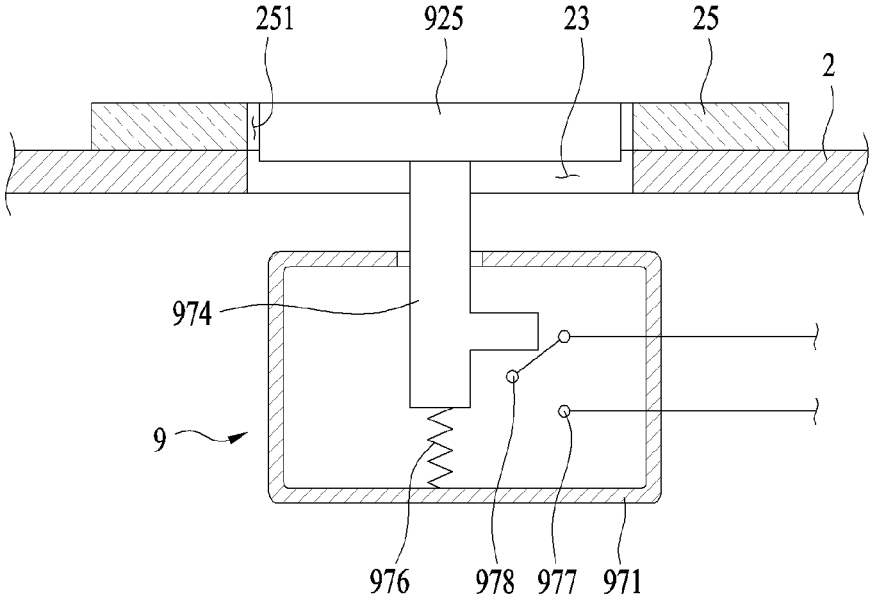

Referring further to FIGS. 4A and 4B, the upper surface 27 of the cabinet 2 includes a cabinet through hole 23 through which the connector unit 9 is exposed to the outside of the cabinet 2. A bottom surface of the second treatment apparatus T (a bottom surface of the second cabinet 1) may be provided with a switch actuator 13 for pressing the connector unit 9.

As shown in FIGS. 4A and 4B, the switch actuator 13 may be embodied as a cabinet protrusion protruding from the bottom surface of the second cabinet 1. In this case, the upper surface 27 of the cabinet 2 may further provided with a bracket 25 for supporting the bottom surface of the second cabinet 1. The bracket 25 may include a bracket through hole 251 that accommodates the switch actuator 13.

The connector unit 9 according to the present disclosure may be formed simply by a switch disposed in the cabinet 2.

The switch may include a switch body 971 secured in the cabinet 2, a slider 974 one end of which extends through the cabinet through hole 23 and is exposed to the outside of the cabinet 2 and the other end of which reciprocates in the switch body 971, and contacts 977 and 978 disposed in the switch body 971 to open and close the circuit (communication circuit or power circuit) by the slider 974.

The switch body 971 includes a body through hole 973 through which the slider 974 passes. Since the body through hole 973 is positioned under the cabinet through hole 23, the switch may be fail when water is introduced into the cabinet 2 through the cabinet through hole 23.

In order to prevent failure of the switch, the switch body 971 may be provided with a sealing member 99, thus preventing water from flowing into the switch body 971 through the body through hole 973.

The sealing member 99 may be configured to have any shape so long as it is disposed on the body through hole 973 to seal the body through hole 973. FIG. 4 illustrates an implementation in which the sealing member 99 covers an outer circumferential surface of the slider 974 exposed to the outside of the switch body 971 and an upper surface of the switch body 971 (one side of the switch body 971 that faces the cabinet through hole 23).

Since movement of the slider 974 may be restricted when the sealing member 99 is configured in a fashion shown in FIG. 4, the sealing member 99 may be made of an elastic material such as rubber.

The slider 974 is supported by an elastic support 976 disposed in the switch body 971. Consequently, when the second treatment apparatus T is mounted on the first treatment apparatus L, the slider 974 is moved toward the contacts 977 and 978. When the second treatment apparatus T is separated from the first treatment apparatus L, the slider 974 is moved away from the contacts 977 and 978.

The contacts may include a first contact 977 secured in the switch body 971, and a second contact 978 hinged in the switch body 971 and connected to the first contact 977 by the slider 974.

When the connector unit 9 is configured to open and close the communication circuit between the control unit C and the component group to be controlled, one of the control unit C and the component group may be connected to the first contact 977 and the other of control unit C and the component group may be connected to the second contact 978.

When the connector unit 9 is configured to open and close the power circuit for supplying power to the components to be controlled (FIG. 2B), one of the control unit C and the component group may be connected to the power source S and the other of control unit C and the component group may be connected to the second contact 978.

Since the connector unit 9 shown in FIG. 4A includes the slider 974 configured into a bar shape having a small cross-sectional area, there is a probability that the switch actuator 13 cannot press the slider 974 even though the second treatment apparatus T is mounted on the first treatment apparatus L.

In order to address this problem, the connector unit 9 may further include a support plate 925 fixed to the slider 974 and positioned in the cabinet through hole 23 to contact the switch actuator 13.

As shown in FIG. 4B, the support plate 925 may have a surface area larger than a cross-sectional area of the slider 974. When the support plate 925 is provided on the slider 974, the sealing member 99 serving to prevent water from being introduced through the body through hole 973 may not be necessary.

Figure 5A:
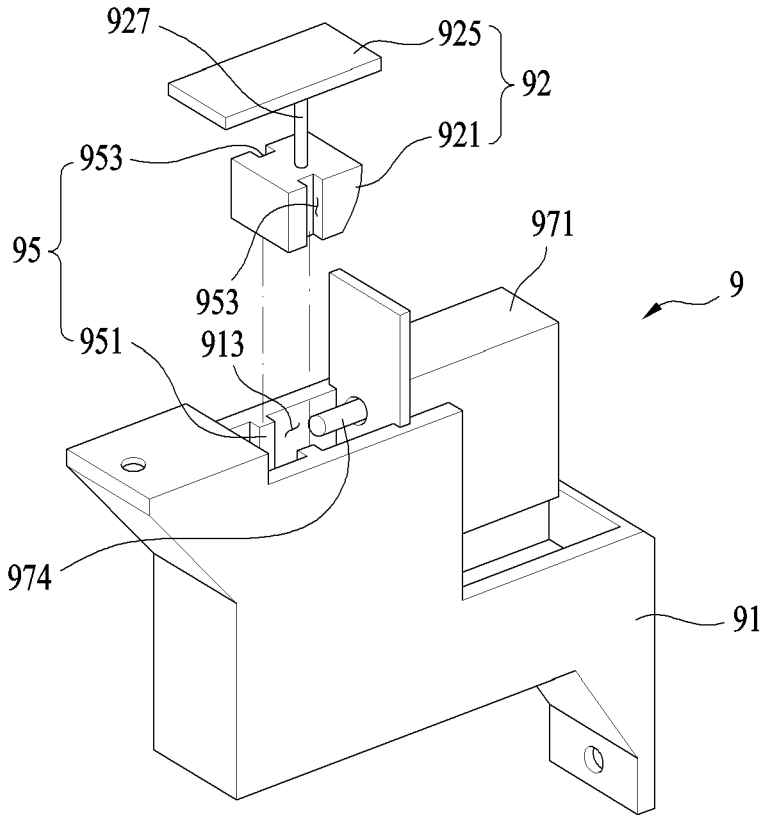
FIGS. 5A and 5B are views showing a connector unit provided in the laundry treatment apparatus according to another implementation.
Figure 5B:
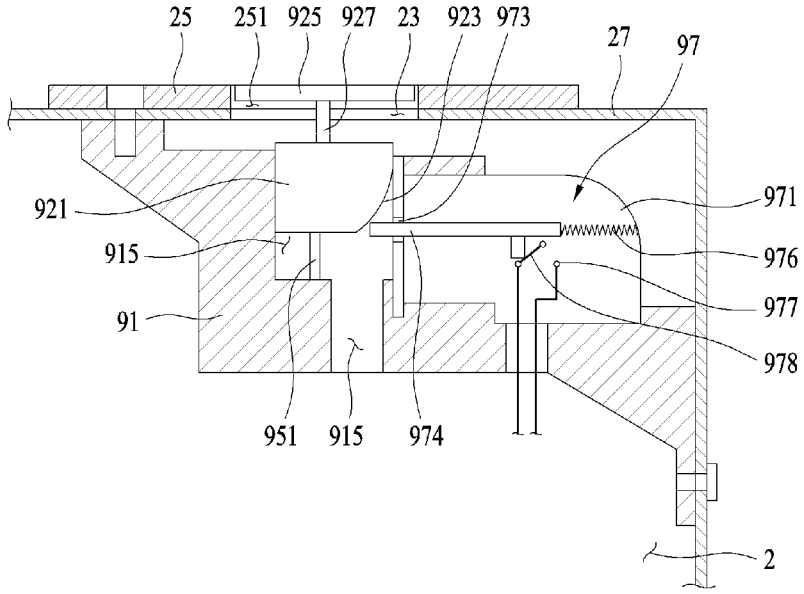

FIGS. 5A and 5B illustrate a further implementation of the connector unit 9 according to the present disclosure.

The connector unit 9 according to the implementation may include a housing 91 secured in the cabinet 2, a housing through hole 915 formed through the housing 91 and disposed under the cabinet through hole 23, a switch 97 disposed outside the housing through hole 915 to open and close the circuit for connecting the control unit C to the components to be controlled, and a press unit 92 disposed in the housing through hole 915 in a reciprocating manner to actuate the switch 97 when the second treatment apparatus T is mounted on the first treatment apparatus L.

The switch 97 according to the implementation may include a switch body 971 fixed to the housing 91, a slider 974 one end of which is disposed in the housing through hole 915 and the other end of which reciprocates in the switch body 971, and contacts 977 and 978 disposed in the switch body 971 to open and close the circuit (communication circuit or power circuit) by the slider 974.

According to the implementation, since the housing through hole 915 is positioned under the cabinet through hole 23 and the switch 97 is positioned outside the housing through hole 915, there is a low probability of failure of the switch 97 due to introduction of water into the switch 97 even if water is introduced into the cabinet 2 through the cabinet through-hole 23.

The press unit 92 may include a support plate 925 disposed in the cabinet through hole 23 to contact the switch actuator 13 of the second treatment apparatus T, and a press body 921 disposed in the housing through hole 915 and connected to the support plate 925.

The press body 921 may protrude from the support plate 925 and may be disposed in the housing through hole 915. Furthermore, the press body 921 may be connected to the support plate 925 via the connecting rod 927 as shown in the drawing.

When the support plate 925 is pressed by the switch actuator 13 of the second treatment apparatus, the press body 921 moves along the housing through hole 915 and then presses the slider 974 of the switch.

In order to allow the slider 974 to be easily pressed by the press body 921, one surface of the press body 921 that presses an end of the slider 974 exposed through the housing through hole 915 may be embodied as an inclined surface 923.

The inclined surface 923 may be provided at one end of the slider 974 protruding through the housing through hole 915, and may be provided at both the one end of the slider 974 protruding through the housing through hole 915 and the one surface of the press body 921 adapted to press the slider 974.

Since the slider 974 is supported on the switch body 971 by means of the elastic support 976, when the second treatment apparatus T is separated from the first treatment apparatus L, the one end of the slider 974 presses the press body 921, thus restoring the press unit 92 to the initial position (FIG. 5(*b*)).

When the second treatment apparatus T is separated from the first treatment apparatus L, the housing through hole 915 may be provided with an elastic support for supporting the press body 921 so as to enable the press unit 92 to be easily restored to the initial position.

The connector unit 9 shown in FIG. 5 may further include a press guider unit 95 for guiding reciprocation of the press body 921 in the housing through hole 915.

The press guider unit 95 may include a protrusion 951 provided at one of the press body 921 and the housing through hole 915, and a guide groove 953 provided at the other of the press body 921 and the housing through hole 915 and receiving the protrusion.

FIG. 5 illustrates an implementation in which the protrusion 951 is provided at an inner surface of the housing through hole 915 in a height direction of the housing through hole 915 and the guide groove 953 is formed at an outer surface of the press body 921.

As described above, the present disclosure can provide a laundry treatment apparatus which is used to support an apparatus for laundry treatment (a drying machine, a washing machine, a combined machine for drying and washing and the like) and which can perform both washing and drying of laundry.

Furthermore, the present disclosure can provide a laundry treatment apparatus capable of performing a function of treating laundry only when an additional laundry treatment apparatus is mounted on an upper surface thereof.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A laundry treatment apparatus comprising:

a cabinet;

a drum disposed in the cabinet the drum defining a space for receiving laundry;

a driving unit configured to rotate the drum;

an input unit configured to allow a user to input control commands;

a control unit configured to control the driving unit and receive the control commands from the input unit; and a connector unit configured to open and close at least one circuit comprising one or more of a circuit that connects the control unit to the driving unit, a circuit that connects the control unit to the input unit, or a circuit that supplies power to at least one of the control unit, the driving unit, or the input unit, wherein the connector unit comprises a switch configured to close the at least one circuit based on being pressed by an object that is configured to be installed on one of outer surfaces of the cabinet, and to open the at least one circuit based on the object being absent from the one of the outer surfaces of the cabinet.

2. The laundry treatment apparatus according to claim 1, wherein the control unit is configured to communicate with the driving unit based on the connector unit closing the circuit that connects the control unit to the driving unit.

3. The laundry treatment apparatus according to claim 1, wherein the control unit is configured to communicate with the input unit based on the connector unit closing the circuit that connects the control unit to the input unit.

4. The laundry treatment apparatus according to claim 1, wherein the connector unit is configured to allow power to be supplied to the at least one of the control unit, the driving unit, or the input unit based on closing the circuit that supplies power to the at least one of the control unit, the driving unit, or the input unit.

5. The laundry treatment apparatus according to claim 1, wherein the connector unit comprises:

a switch body mounted within the cabinet, the switch body defining a body through hole;

a slider disposed in the body through hole, a first end of the slider being exposed to an outside of the cabinet and a second end of the slider being configured to reciprocate within the switch body; and a contact disposed in the switch body and configured to open and close the circuit by being manipulated by the slider.

6. The laundry treatment apparatus according to claim 5, further comprising:

a cabinet through hole provided in the one of the outer surfaces of the cabinet where the object is installed on; and a support plate fixed to the slider and disposed in the cabinet through hole, wherein the slider has a surface area larger than a cross-sectional area of the slider.

7. The laundry treatment apparatus according to claim 6, further comprising a sealing member configured to prevent foreign materials from being introduced into the switch body through the body through hole.

8. The laundry treatment apparatus according to claim 1, further comprising a cabinet through hole provided in the one of the outer surfaces of the cabinet where the object is installed on, and wherein the connector unit comprises:

a housing mounted within the cabinet, the housing defining a through hole that is disposed to communicate with the cabinet through hole;

a switch fixed to the housing and configured to open and close the at least one circuit; and a press unit configured to reciprocate within the housing through hole to actuate the switch.

9. The laundry treatment apparatus according to claim 8, wherein the switch comprises:

a switch body fixed to the housing and disposed outside the housing through hole;

a slider having a first end disposed in the housing through hole and a second end configured to reciprocate within the switch body; and a contact disposed in the switch body and configured to open and close the at least one circuit by being manipulated by the slider.

10. The laundry treatment apparatus according to claim 9, further comprising a press guider unit configured to guide reciprocating movement of the press unit within the housing through hole.

11. The laundry treatment apparatus according to claim 9, wherein the press unit comprises:

a support plate disposed in the cabinet through hole and configured to contact the object when the object is installed on the cabinet; and a press body configured to reciprocate within the housing through hole by movement of the support plate that presses the slider.

12. The laundry treatment apparatus according to claim 11, further comprising an inclined surface provided at at least one of the press body and the first end of the slider exposed through the housing through hole.

13. The laundry treatment apparatus according to claim 1, wherein the object is a second laundry treatment apparatus that comprises:

a second cabinet configured to actuate the connector unit by being installed on the cabinet;

a second drum disposed in the second cabinet, the second drum defining a space configured to receive laundry; and a second driving unit configured to rotate the second drum.

14. The laundry treatment apparatus according to claim 1, wherein the one of the outer surfaces of the cabinet is an upper surface of the cabinet that is exposed to an outside of the cabinet, and wherein the switch is configured to open and close the at least one circuit based on the object being installed on the upper surface of the cabinet.

15. The laundry treatment apparatus according to claim 1, wherein the switch is configured to be pressed downward into the cabinet based on the object being installed on an upper surface of the cabinet.

16. The laundry treatment apparatus according to claim 1, wherein at least a portion of the switch passes through an upper surface of the cabinet.

* * * * *